United States Patent [19]

Kylberg

[11] 4,298,008

[45] Nov. 3, 1981

[54] DEVICE FOR BRASSIERES

[76] Inventor: Nadia M. Kylberg, Angsklockevagen 50, S-181 61 Lidingo, Sweden

[21] Appl. No.: 98,072

[22] Filed: Nov. 28, 1979

[30] Foreign Application Priority Data

Jun. 21, 1979 [SE] Sweden ..... 7905488

[51] Int. Cl.[3] ..... A41C 1/14

[52] U.S. Cl. ..... 128/477

[58] Field of Search ..... 128/477, 463, 465

[56] References Cited

U.S. PATENT DOCUMENTS

| | | | |
|---|---|---|---|
| 2,408,106 | 4/1949 | Polk et al. | 128/477 |
| 2,621,328 | 12/1952 | Duchnofskey | 128/477 |
| 3,351,954 | 11/1967 | Chalfin et al. | 128/465 |

FOREIGN PATENT DOCUMENTS

| | | | |
|---|---|---|---|
| 1036233 | 4/1953 | France | 128/477 |

*Primary Examiner*—Doris L. Troutman

*Attorney, Agent, or Firm*—Craig and Antonelli

[57] ABSTRACT

A device for brassieres is described which renders the brassiere elastic and steady and allows the bust to be supported from below, by the body underneath the bust, so that the strain in shoulder straps, if present, becomes a minimum, without the need of providing the brassiere with stiffening metal strips or springs. The device according to the invention comprises a band-shaped member of a flexible, supporting material, provided in either half of the brassiere from the area at the center of the brassiere in a direction towards the end of the brassiere. The band-shaped member is foldable along a longitudinal line, which partially extends substantially along the lower edge of the cup of the half of the brassiere so that, upon use, one part of the band-shaped member on one side of said line bears against the lower side of the bust so as to support it with the support from the other part of the member, which bears against the body underneath the bust. Transverse slots are formed in the longitudinal edges of the band-shaped member so that the member will smoothly adjust itself to the shape of the bust and the body. The device according to the invention may be used in any standard type of brassieres, in sun dresses, swimming suits, etc.

10 Claims, 3 Drawing Figures

DEVICE FOR BRASSIERES

Figure 1:
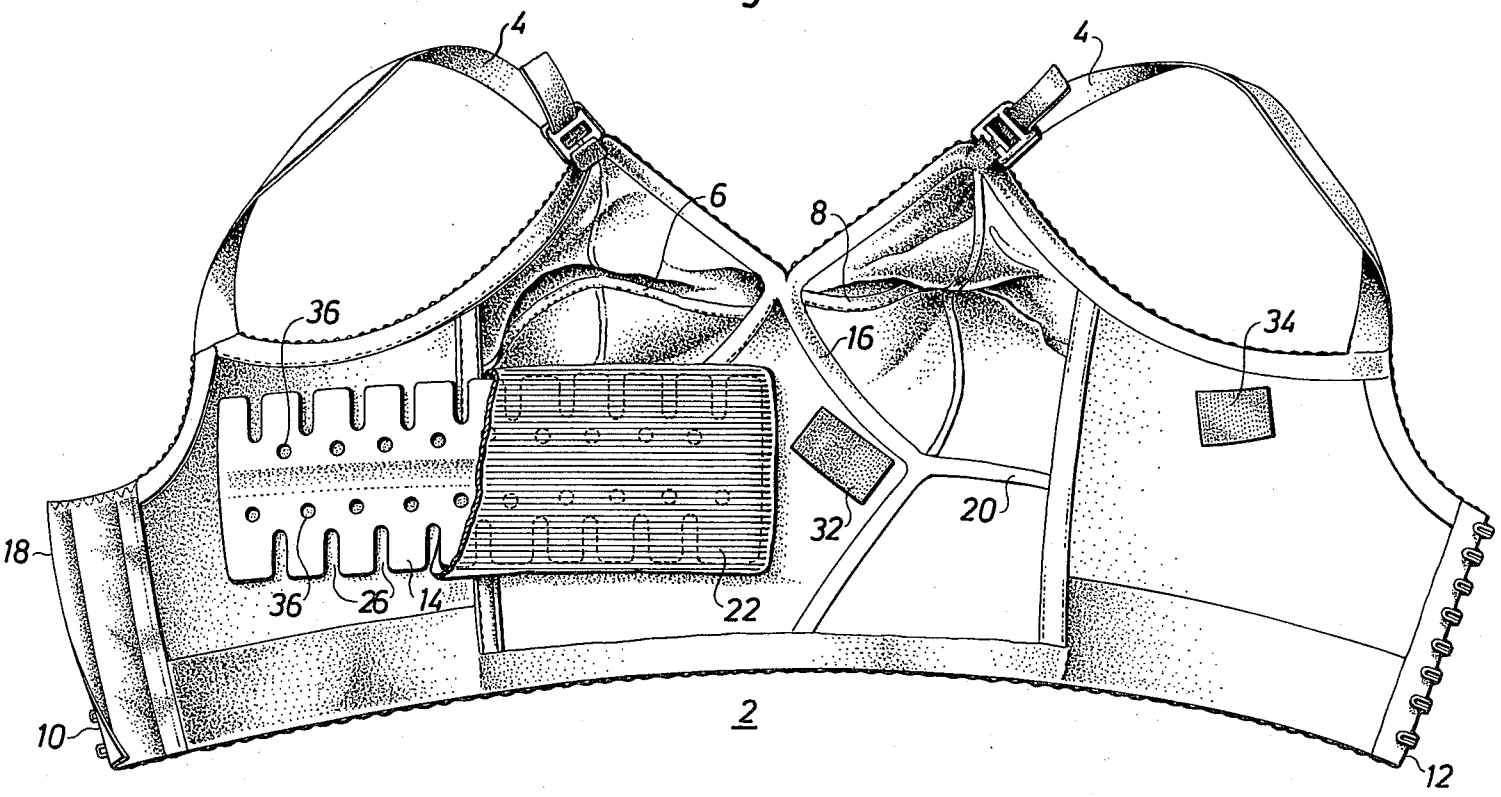

The present invention relates to a device for brassieres.

In conventional brassieres the bust is supported by means of shoulder straps. A great disadvantage of this type of brassieres, particularly for a heavy bust, is that the shoulder straps must be tensely tightened in order to hold up the bust, and due to the weight of the bust the shoulder straps "cut" into the shoulders and load them so that medical damages may occur.

Strapless brassieres for e.g. sun dresses, certain types of ball dresses, etc. are also previously known. In this type of brassieres bars or springs of metal are provided in the cups of the brassiere and secured in a support or corset portion below the cups so as to provide sufficient support for the bust. By the bar or spring structure this type of brassiere becomes very stiff and uncomfortable to wear.

The object of the present invention is to eliminate said disadvantages in previously known types of brassieres.

Said object is obtained by a device comprising in each half of the brassiere a band-shaped member of a flexible, supporting material extending from the area at the centre of the brassiere in the direction towards the end of the brassiere, said member being foldable along a longitudinal line, which partially extends substantially along the lower edge of the cup of the half of the brassiere, so that in use that part of the band-shaped member which is located on one side of said line bears against the lower side of the bust so as to support it with the support from the other part of said member, which below the bust bears against the body, transverse slots being formed in the longitudinal edges of the band-shaped member so that said member smoothly adjusts itself to the shape of the bust and the body.

By means of the structure defined above the band-shaped member is flexible in two directions so that it will adjust itself smoothly to the shape of the bust and the body, especially at the transition between the lower side of the bust and the portion of the body situated therebelow. In spite of the fact that the device of the invention is manufactured of a relatively rigid material in order to give the required support for the bust, a brassiere with the device according to the invention will feel soft and comfortable to wear and present a good fit, which gives an attractive visual sensation. Since the supporting member is formed like a band, which in each half of the brassiere may extend from the centre of the brassiere right to the back of the wearer, the weight of the bust will be distributed over a large area of the body below the bust, whereby the weight of even a very heavy bust is carried without inconvenience.

The device according to the invention can be used in all standard brassieres, i.e. in brassieres both with and without shoulder straps. In brassieres with shoulder straps the tension in the shoulder straps will be very weak, since the bust is supported from below.

In one preferred embodiment the slots are provided in a zigzag along the longitudinal edges of the band-shaped member and the slots are preferably of V-shape with the apex directed inwardly towards the centre line of the member. The length of the slots may be approximately one third of the width of the band-shaped member. A suitable material for the band-shaped member may be a plastic, e.g. a polyvinyl plastic, covered by a textile material, preferably of cotton fabric. Breathing apertures are then preferably provided in the plastic material. Instead of a plastic a stiff textile material can be used.

The device according to the invention can be secured within the brassiere by means of teasel tape.

An exemplary embodiment of the invention will be described below with reference to the annexed drawings, on which FIG. 1 illustrates the inside of a conventional brassiere with shoulder straps, in one half of which the invention has been provided, FIG. 2 the side directed towards the brassiere of the band-shaped member of the device according to the invention, and FIG. 3 a view from the one short side of the member shown in FIG. 2.

In FIG. 1 a conventional brassiere 2 is illustrated with shoulder straps 4, cups 6,8 for the bust and a buttoning 10,12 for buttoning the brassiere at the back of the wearer.

In one half of the brassiere, the left half in FIG. 1, an elongated band-shaped member 14 is shown. Said band-shaped member 14 extends from the area at the centre 16 of the brassiere outwards towards the end 18 of the brassiere. The band-shaped member 14 is foldable along its longitudinal centre line and the band-shaped member 14 is arranged so that said centre line extends along the lower edge of the cup 6, the corresponding lower edge of the cup 8 being indicated at 20. By this the band-shaped member 14 upon use of the brassiere will adjust itself smoothly to the transition between the lower side of the bust and the body underneath.

The band-shaped member 14 is provided as a flexible but relatively stiff band of a plastic material, such as a polyvinyl plastic H5050, manufactured by Kloster. Said plastic band is covered by a fabric 22, preferably of cotton. In order to illustrate the invention more clearly said cover of fabric 22 has been removed from the left portion of the band-shaped member 14 as shown in FIG. 1.

By extending the band-shaped member 14 right to the back side of the wearer of the brassiere a perfect fit is attained without any lateral projections even with a large bust.

Figure 3:
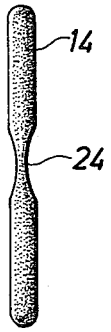

In order to make the band-shaped member 14 foldable along its longitudinal centre line, the band-shaped member is thinner along said line, as is shown at 24 in FIG. 3. Thus, the band presents a waist.

Figure 2:
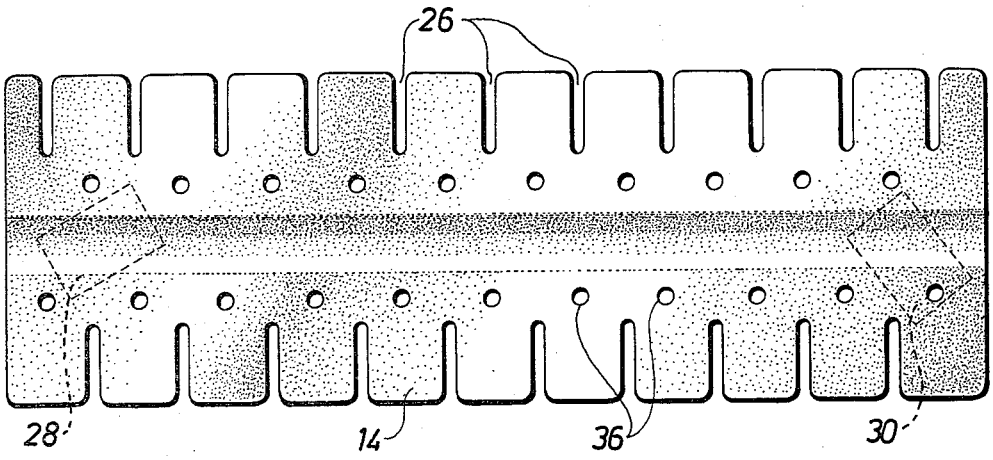

As shown in FIGS. 1 and 2, slots 26 of V-shape are formed in the longitudinal edges of the band-shaped member 14. The slots 26 extend perpendicularly to the longitudinal direction of the band-shaped member 14 to approximately one third of the width of the band-shaped member 14. In this way the band-shaped member may be bent around the body and the bust without bulges being formed.

The band-shaped member 14 is secured to the brassiere 2 with teasel tape, fastened on one hand to the side of the band-shaped member 14 directed towards the brassiere, at 28 and 30, and on the other hand at corresponding positions to the inside of the brassiere, illustrated at 32 and 34 in the righthand half of the brassiere in FIG. 1. In this manner the device according to the invention may be provided in a simple manner in each brassiere of standard type.

In the band-shaped member 14 there are further provided a number of "breathing apertures" 36 for the skin.

In order to render FIG. 1 clearer only the lefthand half of the brassiere is illustrated as provided with the device according to the invention. In practice also the righthand half is, of course, provided with such a device.

It is obvious that a plurality of modifications can be carried out within the scope of the present invention. Thus, evidently the length and width of the band-shaped member 14 can be varied for adaption to busts and brassieres of various sizes. The form of the transverse slots 26 may, of course, be modified and their number and lengths changed. Instead of cotton fabric the plastic band may be covered by, e.g., Nylon tulle. Instead of forming the band-shaped member 14 of plastic, it may be manufactured of a relatively stiff textile material, such as, e.g., fleeceline, and the band-shaped member 14 may, of course, also be fastened in the brassiere in various manners, e.g., be located in a pocket. If desired, the breathing apertures may be formed in the tongues between the slots 26. Further, in the embodiment shown in the drawings the band-shaped member 14 is symmetrical in relation to the longitudinal line or waist along which the member is foldable. However, of course this folding line does not need to extend in the middle of the band-shaped member 14, but the band-shaped member 14 can be unsymmetrically designed in the relation to said line, so that e.g. the part of band-shaped member 14 situated below said line and adapted to bear against the body presents a larger width than the other part of the member. The lower part of the band-shaped member 14 can be formed wider e.g. so that the lower edge of the band-shaped member 14 will extend along the associated part of the lower edge of the brassiere. Such an embodiment improves the support from the body below the bust since the contact surface of the band-shaped member 14 against the body is increased, and such an enhanced support may be advantageous to brassieres designed very heavy busts.

As mentioned above, the device according to the invention can be used in brassieres of every standard type. In addition thereto, it can be used in sun dresses, swimming suits, etc.

I claim:

1. A device for brassieres characterized in that in each half of the brassiere is provided an essentially quadrangular band-shaped member of a flexible, supporting material extending from the area at the centre of the brassiere in the direction towards the back part of the brassiere, said band-shaped member having a thinner portion extending along a longitudinal line so as to be foldable along said line, which partially extends substantially along the lower edge of the cup of said half of the brassiere, so that in use the part of the band-shaped member which is located on one side of said line bears against the lower side of the bust so as to support it with the support from the other part of said band-shaped member, which below the bust bears against the body, transverse slots being formed in both the longitudinal edges of the band-shaped member so that said band-shaped member smoothly adjusts itself to the shape of the bust and the body.

2. The device as claimed in claim 1, characterized in that said transverse slots are provided in a zigzag in the longitudinal edges of the band-shaped member.

3. The device as claimed in claim 1 or 2, characterized in that said slots are of substantially V-shape with their apex directed inwardly towards said longitudinal line of said member.

4. The device as claimed in one of claims 1 or 2, characterized in that the length of the slots is approximately one third of the width of the band-shaped member.

5. The device as claimed in one of claims 1 or 2, characterized in that the band-shaped member is comprised of a plastic material, covered by a textile material.

6. The device as claimed in one of claims 1 or 2, characterized in that said band-shaped member is comprised of a relatively stiff textile material, such as e.g., fleeceline.

7. The device as claimed in one of claims 1 or 2, characterized in that said band-shaped member is secured at the inside of the brassiere by means of teasel tape.

8. The device as claimed in claim 1, characterized in that said longitudinal line is unsymmetrically formed on the band-shaped member, so that the part of the member adapted to bear against the body below the bust is wider than the part located on the other side of said line.

9. The device as claimed in claim 5, characterized in that said textile material is formed of cotton fabric.

10. The device as claimed in claim 5, characterized in that breathing apertures for the skin are formed in the plastic material.

* * * * *